US010410654B2

(12) United States Patent
Tong et al.

(10) Patent No.: US 10,410,654 B2
(45) Date of Patent: Sep. 10, 2019

(54) ACTIVE NOISE CONTROL HEADPHONES

(71) Applicant: BESTECHNIC (SHANGHAI) CO., LTD., Shanghai (CN)

(72) Inventors: Weifeng Tong, Shanghai (CN); Mingliang Xu, Shanghai (CN); Liang Zhang, Shanghai (CN); Lei Yang, Shanghai (CN); Like Zheng, Shanghai (CN)

(73) Assignee: BESTECHNIC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/172,763

(22) Filed: Oct. 27, 2018

(65) Prior Publication Data

US 2019/0130930 A1 May 2, 2019

(30) Foreign Application Priority Data

Oct. 27, 2017 (CN) ..... 2017 1 1026343
Aug. 15, 2018 (CN) ..... 2018 1 0927251

(51) Int. Cl.
*G10L 21/0264* (2013.01)
*H04R 5/04* (2006.01)
(Continued)

(52) U.S. Cl.
CPC ..... *G10L 21/0264* (2013.01); *G10K 11/178* (2013.01); *G10L 21/0208* (2013.01);
(Continued)

(58) Field of Classification Search
CPC ..... G10L 21/0264; G10L 2021/02082; H04R 5/033; H04R 5/04; H04R 2460/01
See application file for complete search history.

(56) References Cited

U.S. PATENT DOCUMENTS 8,243,946 B2 8/2012 Burge et al.
2004/0101038 A1* 5/2004 Etter ..... H04B 1/123 375/222
(Continued)

FOREIGN PATENT DOCUMENTS

CN 101877808 A 11/2010

OTHER PUBLICATIONS

Office Action issued in counterpart Chinese Application No. 201711026343.5, dated Feb. 2, 2019, 7 pages.

*Primary Examiner* — Davetta W Goins
*Assistant Examiner* — Daniel R Sellers
(74) *Attorney, Agent, or Firm* — Bayes PLLC

(57) ABSTRACT

Embodiments of active noise control (ANC) headphones and operating methods thereof are disclosed herein. In one example, a headphone for ANC includes a speaker, a microphone, an echo-cancel module, and an ANC module. The speaker is configured to play an audio based on a first audio source signal. The microphone is configured to obtain a mixed audio signal including a noise signal and a second audio source signal based on the audio played by the speaker. The echo-cancel module is configured to reduce the second audio source signal from the mixed audio signal based on the first audio source signal to generate an echo-cancel audio signal. The ANC module is operatively coupled to the echo-cancel module and configure to generate a noise-controlled audio source signal to be played by the speaker based on the echo-cancel audio signal and the first audio source signal.

12 Claims, 6 Drawing Sheets

(51) Int. Cl.

| | |
|---|---|
| ***H04R 5/033*** | (2006.01) |
| ***G10K 11/178*** | (2006.01) |
| ***G10L 21/0208*** | (2013.01) |

(52) U.S. Cl.
CPC ..... *H04R 5/033* (2013.01); *H04R 5/04* (2013.01); *G10L 2021/02082* (2013.01); *H04R 2460/01* (2013.01)

(56) References Cited

U.S. PATENT DOCUMENTS

| | | | | |
|---|---|---|---|---|
| 2005/0207585 | A1 | 9/2005 | Christoph | |
| 2010/0272284 | A1* | 10/2010 | Joho ..... | G10K 11/178 381/71.8 |
| 2013/0129108 | A1 | 5/2013 | Wurm | |
| 2014/0126734 | A1* | 5/2014 | Gauger, Jr. ..... | H04R 3/002 381/71.6 |
| 2016/0300562 | A1* | 10/2016 | Goldstein ..... | G10K 11/17815 |

* cited by examiner

ACTIVE NOISE CONTROL HEADPHONES

CROSS-REFERENCE TO RELATED APPLICATIONS

This application claims the benefit of priority to Chinese Patent Application No. 201711026343.5 filed on Oct. 27, 2017 and Chinese Patent Application No. 201810927251.2 filed on Aug. 15, 2018, both of which are incorporated herein by reference in their entireties.

BACKGROUND

Embodiments of the present disclosure relate to headphones.

Loudspeakers, including headphones, have been widely used in daily life. Headphones can include a pair of small loudspeaker drivers worn on or around the head over a user's ears, which convert an electrical signal to a corresponding acoustic signal.

Active noise control (ANC), also known as noise cancellation, or active noise reduction (ANR), is a method for reducing unwanted sound by the addition of a second sound specifically designed to cancel the first sound. ANC can be achieved by a feedback loop and/or a feed forward loop. Conventional ANC headphones, however, suffer from issues such as volume reduction and audio quality loss because the audio being played may be affected by the ANC as well. Also, conventional ANC headphones are vulnerable to low frequency noise (e.g., less than 100 Hz) with high amplitude due to saturation of the low frequency noise.

SUMMARY

Embodiments of ANC headphones and operating methods thereof are disclosed herein.

In one example, a headphone for ANC includes a speaker, a microphone, an echo-cancel module, and an ANC module. The speaker is configured to play an audio based on a first audio source signal. The microphone is configured to obtain a mixed audio signal including a noise signal and a second audio source signal based on the audio played by the speaker. The echo-cancel module is configured to reduce the second audio source signal from the mixed audio signal based on the first audio source signal to generate an echo-cancel audio signal. The ANC module is operatively coupled to the echo-cancel module and configure to generate a noise-controlled audio source signal to be played by the speaker based on the echo-cancel audio signal and the first audio source signal.

In another example, headphone for ANC includes an external microphone, a speaker, an internal microphone, an echo-cancel module, and an ANC module. The external microphone is configured to obtain a first talk-through audio signal. The speaker is configured to play an audio based on the first talk-through audio signal. The internal microphone is configured to obtain a mixed audio signal including a noise signal and a second talk-through audio signal based on the audio played by the speaker. The echo-cancel module is configured to reduce the second talk-through audio signal from the mixed audio signal based on the first talk-through audio signal to generate an echo-cancel audio signal. The ANC module is operatively coupled to the echo-cancel module and configure to generate a noise-controlled talk-through audio signal to be played by the speaker based on the echo-cancel audio signal and the first talk-through audio signal.

In a different example, a method for ANC is disclosed. An audio is played based on a first audio signal by a speaker. A mixed audio signal including a noise signal and a second audio signal based on the audio played by the speaker is obtained by a microphone. The second audio signal is reduced from the mixed audio signal based on the first audio signal to generate an echo-cancel audio signal by a processor. A noise-controlled audio signal to be played by the speaker is generated based on the echo-cancel audio signal and the first audio signal by the processor.

This Summary is provided merely for purposes of illustrating some embodiments to provide an understanding of the subject matter described herein. Accordingly, the above-described features are merely examples and should not be construed to narrow the scope or spirit of the subject matter in this disclosure. Other features, aspects, and advantages of this disclosure will become apparent from the following Detailed Description, Figures, and Claims.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

Figure 1:
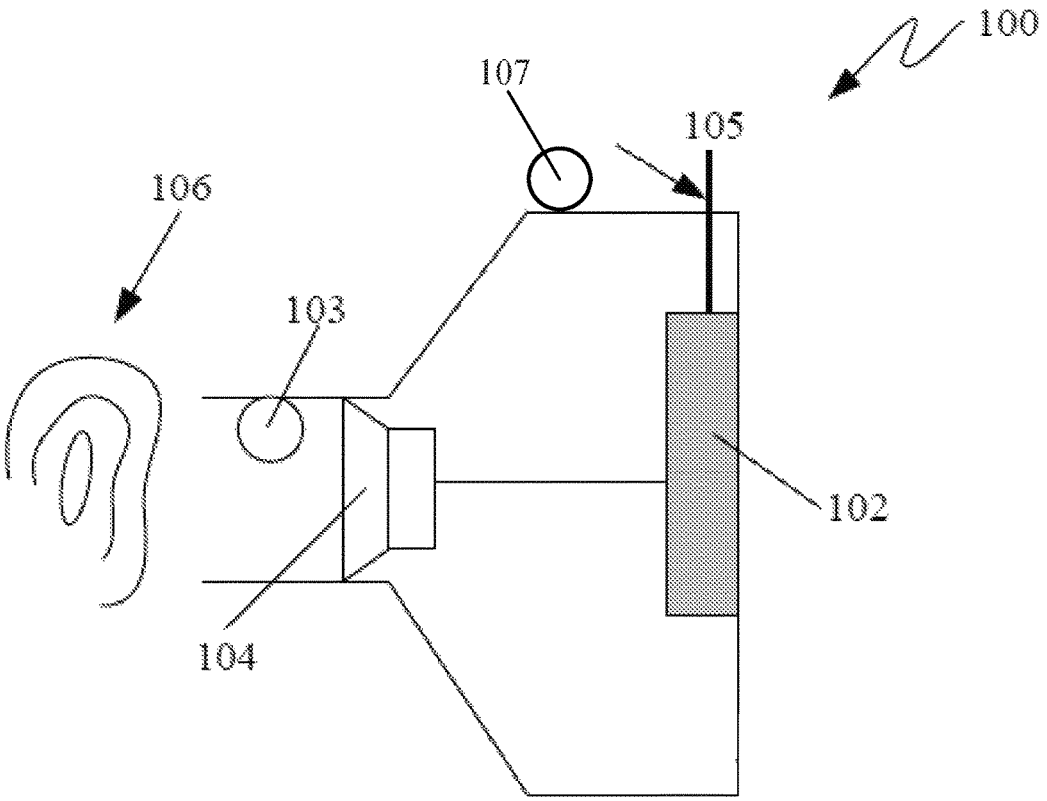
FIG. 1 is a schematic diagram illustrating an exemplary ANC headphone in accordance with an embodiment of the present disclosure.

The presented disclosure is described with reference to the accompanying drawings. In the drawings, generally, like reference numbers indicate identical or functionally similar elements. Additionally, generally, the left-most digit(s) of a reference number identifies the drawing in which the reference number first appears.

DETAILED DESCRIPTION

Although specific configurations and arrangements are discussed, it should be understood that this is done for illustrative purposes only. It is contemplated that other configurations and arrangements can be used without departing from the spirit and scope of the present disclosure. It is further contemplated that the present disclosure can also be employed in a variety of other applications.

It is noted that references in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic.

Moreover, such phrases do not necessarily refer to the same embodiment. Further, when a particular feature, structure or characteristic is described in connection with an embodiment, it is contemplated that such feature, structure or characteristic may also be used in connection with other embodiments whether or not explicitly described.

In general, terminology may be understood at least in part from usage in context. For example, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

As will be disclosed in detail below, among other novel features, the ANC headphones disclosed herein can reduce or even eliminate the impact of ANC on audio signals other than the noise signal, thereby improving user experience in various usage scenarios, such as listening to the music and/or talk-through sound. In some embodiments, an echo-cancel function can be implemented by the ANC headphones disclosed herein to cancel out the audio signal of interest from the ANC signal before ANC, such that the ANC signal can be purely noise signal, which does not substantively affect the volume and/or quality of the audio being played. In some embodiments, the echo-cancel function can be utilized by the feedback loop (e.g., for playing music), the feed forward loop (e.g., for playing talk-through sound), or both.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 is a schematic diagram illustrating an exemplary ANC headphone 100 in accordance with an embodiment of the present disclosure. ANC headphone 100 may be a wired or wireless loudspeaker that can be worn on or around the head over a user's ear 106 or inside ear 106. In some embodiments, ANC headphone 100 may be an earbud (also known as earpiece) that can be plugged into the user's ear canal when ANC headphone 100 is worn by the user. In some embodiments, ANC headphone 100 may be part of a headset, which is physically held by a band over the head of the user. ANC headphone 100 may include a processor 102, an internal microphone 103, a speaker 104, an audio receiving unit 105, and an external microphone 107. Audio receiving unit 105 may be an antenna for wirelessly receiving an audio source signal from an audio source (not shown) or an audio cable connected to the audio source for transmitting the audio source signal to processor 102. The audio source may include, but not limited to, a handheld device (e.g., dumb or smart phone, tablet, etc.), a wearable device (e.g., eyeglasses, wrist watch, etc.), a radio, a music player, an electronic musical instrument, an automobile control station, a gaming console, a television set, a laptop computer, a desktop computer, a netbook computer, a media center, a set-top box, a global positioning system (GPS), or any other suitable device. In some embodiments, the audio source signal is a music signal from a music source, such as a phone or a music player.

Speaker 104 may be any electroacoustic transducer that converts an electrical signal (e.g., representing the audio information provided by the audio source) to a corresponding audio sound. In some embodiments, speaker 104 is configured to play an audio based on an audio signal. Internal microphone 103 may be any transducer that converts an audio sound into an electrical signal. Internal microphone 103 may be disposed inside the ear canal when ANC headphone 100 is worn by the user to obtain a mixed audio signal that includes an environmental noise signal and an audio source signal based on the audio played by speaker 104. That is, by disposing internal microphone 103 inside the user's ear canal, any sound in the ear canal can be picked up by internal microphone 103, which includes audio of interest currently being played by speaker (e.g., music) and any environmental noises to be reduced or removed by processor 102. As internal microphone 103 cannot separate the audio of interest from the noises, the mixed sounds are converted by internal microphone 103 into a mixed audio signal that includes both environmental noise signal and audio source signal.

External microphone 107 may be any transducer that converts an audio sound into an electrical signal as well. Different from internal microphone 103, external microphone 107 is disposed outside the user's ear canal when ANC headphone 100 is worn by the user, according to some embodiments. External microphone 107 may be configured to obtain a talk-through audio signal based on the talk-through sound outside the ear canal. That is, when the user wears ANC headphone 100, the user may be interested in hearing certain sounds (i.e., talk-through sounds) outside the ear canal. In one example, when the user walks outside wearing ANC headphone 100, the user may want to hear traffic sounds, e.g., horn sound, to be alerted by any safety risks. In another example, the user may want to talk to someone when wearing ANC headphone 100. External microphone 107 may pick up the talk-through sound and convert it into a corresponding talk-through audio signal, which is eventually played by speaker 104 inside the user's ear canal. That is, in some embodiments, the audio played by speaker 104 includes the talk-through sound alone or with any other audio of interest from the audio source, such as music. It is understood that in some embodiments, external microphone 107 collects environmental noises outside the ear canal and converts the noises into noise signals as well. As a result, external microphone 107 may receive a mixed audio signal including both the talk-through audio signal and the noise signal.

Processor 102 may be any suitable integrated circuit (IC) chips (implemented as an application-specific integrated circuit (ASIC) or a field-programmable gate array (FPGA) that can perform audio signal processing functions. In some embodiments, processor 102 is configured to perform echo-cancel function by reducing or removing the signal of the audio of interest (e.g., music and/or talk-through sound) from the mixed audio signal obtained by internal microphone 103 to generate an echo-cancel audio signal. The echo-cancel signal may include purely noise signal (when the audio signal of interest can be completely removed) or noise signal with reduced audio signal of interest. In some embodiments, processor 102 is further configured to perform ANC function by reducing or removing the noise signal from the audio signal of interest to be played by speaker 104 based on the echo-cancel audio signal. By reducing or removing the audio signal of interest in the echo-cancel audio signal, the degree to which the audio signal of interest may be affected by the ANC function can be significantly reduced or even minimized.

Figure 2:
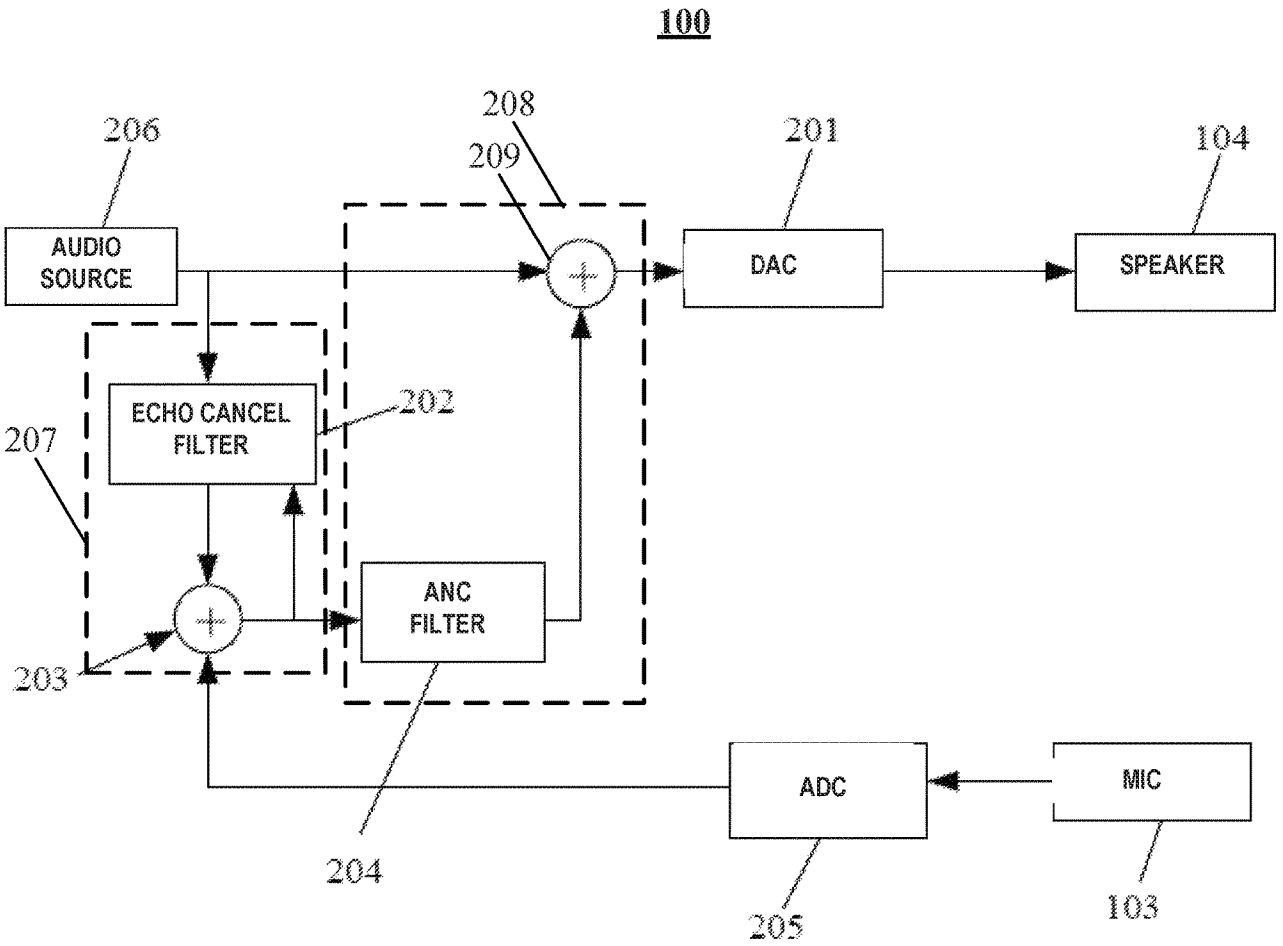
FIG. 2 is a detailed block diagram illustrating the exemplary ANC headphone illustrated in FIG. 1 in accordance with an embodiment of the present disclosure.

For example, FIG. 2 is a detailed block diagram illustrating exemplary ANC headphone 100 illustrated in FIG. 1 in accordance with an embodiment of the present disclosure. As shown in FIG. 2, ANC headphone 100 may include internal microphone 103, speaker 104, and a processor including a digital-to-analog converter (DAC) 201, an analog-to-digital converter (ADC) 205, an echo-cancel module 207, and an ANC module 208. As shown in FIG. 2, an audio source 206 may provide a first audio source signal (e.g., a music signal) to ANC headphone 100, for example, via an antenna or an audio cable (e.g., audio receiving unit 105 shown in FIG. 1). In some embodiments, the first audio source signal is a digital signal that can be converted by DAC 201 to an analog signal and played by speaker 104. That is, speaker 104 may play an audio based on the first audio source signal in an analog format. In some embodiments, the audio is picked by internal microphone 103 along with environmental noises in the ear canal in which internal microphone 103 is disposed. Internal microphone 103 may obtain a mixed audio signal including a noise signal based on the environmental noise and a second audio source signal based on the audio played by speaker 104. That is, the mixed audio signal obtained by internal microphone 103 is based on both the audio of interest (e.g., music) and the noises to be reduced or removed, according to some embodiments. In some embodiments, the mixed audio signal is an analog signal that can be converted by ADC 205 to a digital signal.

Echo-cancel module 207 may be configured to reduce the second audio source signal from the mixed audio signal based on the first audio source signal to generate an echo-cancel audio signal. In some embodiments, echo-cancel module 207 is able to minimize or even remove the second audio source signal from the mixed audio signal. As shown in FIG. 2, in some embodiments, echo-cancel module 207 includes an echo-cancel filter 202 and an adder 203 operatively coupled to one another. Echo-cancel filter 202 may be any suitable digital filters, such as a finite impulse response (FIR) filter, an infinite impulse response (IIR) filter, or a combination of FIR and IIR filters. In some embodiments, echo-cancel filter 202 is configured to receive the first audio source signal from audio source 206 and generate a first cancellation signal based on the first audio source signal. In some embodiments, echo-cancel filter 202 is sensitive to low frequency signal, such as less than 3 KHz, for example, between 500 Hz and 600 Hz. The frequency of first cancellation signal may be less than 3 KHz, for example, between 500 Hz and 600 Hz. Adder 203 may be configured to couple the first cancellation signal and the mixed audio signal to generate the echo-cancel audio signal. In some embodiments, the second audio source signal is canceled out in the echo-cancel audio signal by adder 203.

Figure 3:
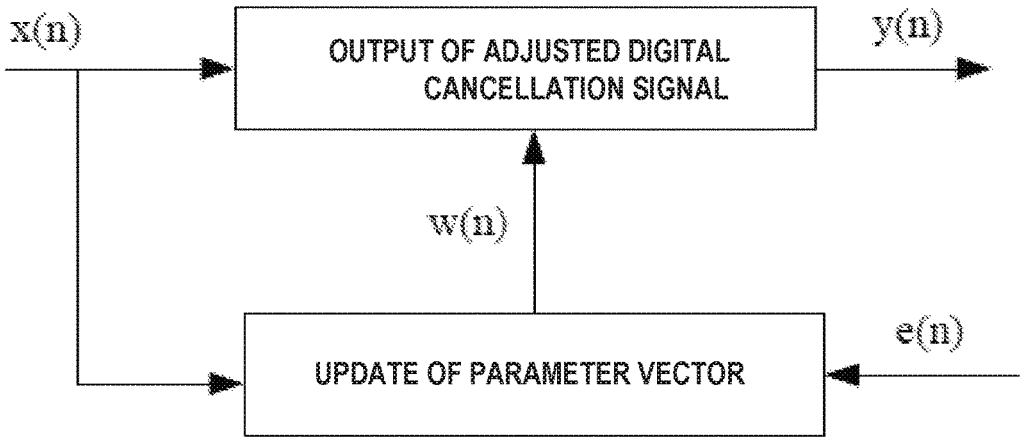
FIG. 3 illustrates an exemplary process of adaptively adjusting filtering parameters in accordance with an embodiment of the present disclosure.

Echo-cancel filter 202 may be a static filter or an adaptive filter. In some embodiments, echo-cancel filter 202 is a static filter, and the filtering parameters are preset static values. In some embodiments, echo-cancel filter 202 is an adaptive filter, which is configured to adaptively adjust one or more parameters associated with the filtering (filtering parameters) based on the output signal of echo-cancel module 207, e.g., the echo-cancel audio signal. In some embodiments, echo-cancel filter 202 is configured to adaptively adjust the filtering parameters based on the input signal of echo-cancel filter 202 as well, e.g., the first audio source signal from audio source 206. For example, FIG. 3 illustrates an exemplary process of adaptively adjusting filtering parameters in accordance with an embodiment of the present disclosure. A parameter vector of the filtering parameters w(n) may be updated based on the echo-cancel audio signal e(n) and the first audio source signal x(n) according to Equation (1) below:

$$w(n+1)=w(n)+2\mu e(n)x(n) \quad (1),$$

where w(n+1) is the updated parameter vector, and μ is the step that is in the range of $0<\mu<2/MP_{in}$, where M is the length of echo-cancel filter 202, and $P_{in}=E[x^2(n)]$ is the input power of first audio source signal x(n). The updated digital cancellation signal y(n) (e.g., the first cancellation signal) may be determined according to Equation (2) below:

$$y(n)=w^T(n)x(n) \quad (2),$$

where $w^T(n)$ is the transpose vector of the parameter vector w(n).

Referring back to FIG. 2, ANC module 208 is operatively coupled to echo-cancel module 207 and is configured to receive the first audio source signal from audio source 206 and the echo-cancel audio signal from echo-cancel filter 202 and generate a noise-controlled audio source signal to be played by speaker 104 based on the echo-cancel audio signal and the first audio source signal. In some embodiments, ANC module 208 is able to minimize or even remove the noise signal from the first audio source signal to achieve the ANC function. Because the second audio source signal has been reduced or even removed from the echo-cancel audio signal, the reduction of first audio source signal from the noise-controlled audio source signal (which can cause volume and/or quality reduction of the audio of interest) can be significantly improved. In some embodiments, ANC module 208 is configured to reduce the gain thereof when the power of its input signal, e.g., the echo-cancel audio signal, is above a threshold, thereby improving the stability of ANC module 208. As shown in FIG. 2, in some embodiments, ANC module 208 includes an ANC filter 204 and an adder 209 operatively coupled to one another. ANC filter 204 may be any suitable digital filters, such as a FIR filter, an IIR filter, or a combination of FIR and IIR filters. In some embodiments, ANC filter 204 is configured to receive the echo-cancel audio signal from echo-cancel module 207 and generate a second cancellation signal based on the echo-cancel audio signal. In some embodiments, ANC filter 204 is sensitive to low frequency signal, such as less than 3 KHz, for example, between 500 Hz and 600 Hz. The frequency of second cancellation signal may be less than 3 KHz, for example, between 500 Hz and 600 Hz. ANC filter 204 may be a static filter or an adaptive filter. In some embodiments, ANC filter 204 is configured to reduce the gain thereof when the power of the echo-cancel audio signal is above a threshold. Adder 209 may be configured to couple the second cancellation signal and the first audio source signal to generate the noise-controlled audio source signal. In some embodiments, the noise signal is canceled out in the noise-controlled audio source signal by adder 209. In some embodiments, the noise-controlled audio source signal is converted from a digital signal to an analog signal by DAC 201, which is then played by speaker 104.

Figure 4:
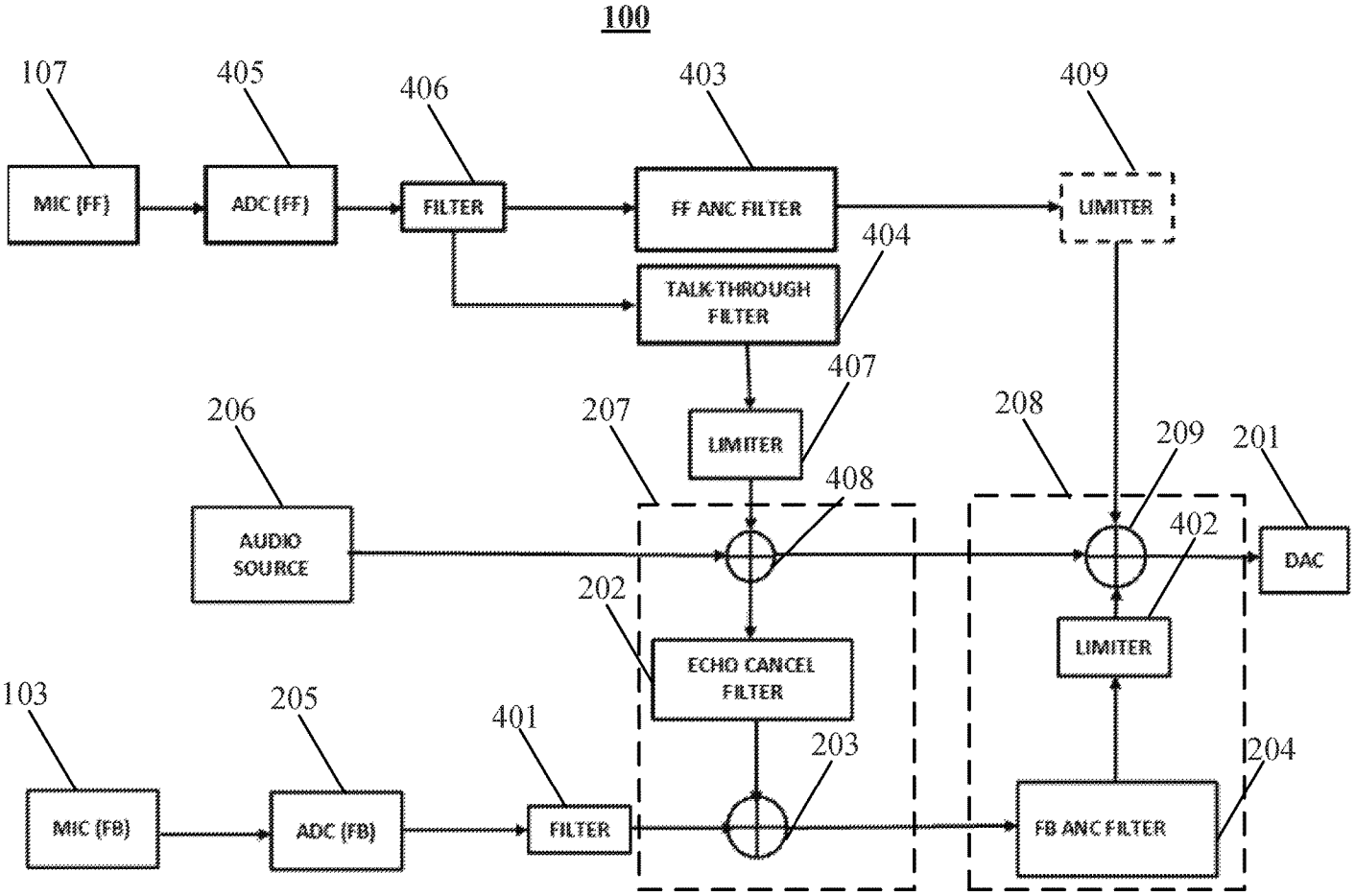
FIG. 4 is another detailed block diagram illustrating the exemplary ANC headphone illustrated in FIG. 1 in accordance with an embodiment of the present disclosure.

FIG. 4 is another detailed block diagram illustrating exemplary ANC headphone 100 illustrated in FIG. 1 in accordance with an embodiment of the present disclosure. Similar to the example illustrated in FIG. 2, the example illustrated in FIG. 4 includes a feedback (FB) loop that can perform substantially the same functions as described above in FIG. 2, which may not be repeated in detail. The feedback loop may include audio source 206, internal microphone 103, ADC 205, echo-cancel module 207 having echo-cancel filter 202 and adder 203, ANC module 208 having ANC filter 204 and adder 209, and DAC 201. In some embodiments, ANC filter 204 is configured to reduce the gain thereof when the power of the echo-cancel audio signal is above a threshold, thereby improving the stability of the feedback loop. In some embodiments, the feedback loop also includes a filter 401 that filters the mixed audio signal before echo-cancel module 207. In some embodiments, filter 401 is a minimum-phase filter with time delay having a sampling rate that can balance the power and time delay of filter 401. For example, the sampling rate of filter 401 is between 100 kHz and 500 kHz.

Figure 6:
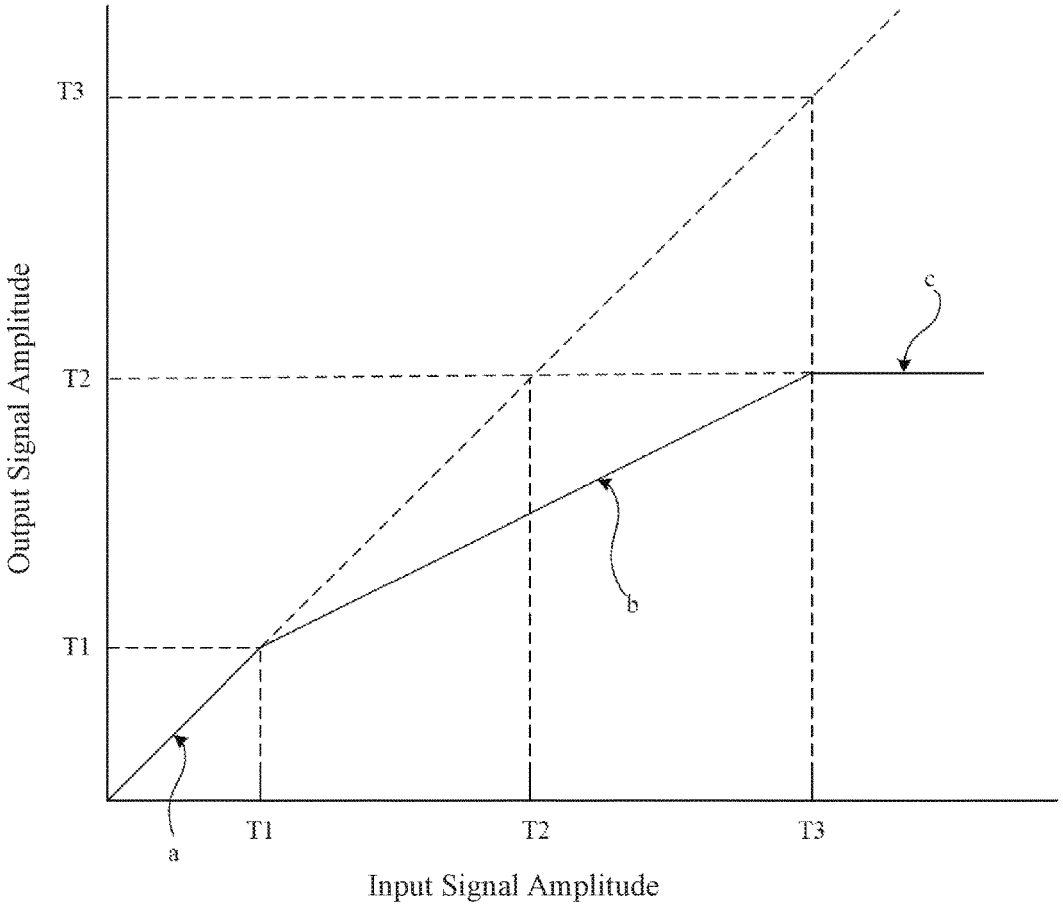
FIG. 6 is an exemplary diagram illustrating compression of signal amplitude by a limiter in accordance with an embodiment of the present disclosure.

In some embodiments, the feedback loop further includes a limiter 402 between ANC filter 204 and adder 209, as part of ANC module 208. Limiter 402 may be arranged before DAC 201 to perform anti-saturation function to compress the amplitude of the signal, for example, by dynamic range compression (DRC) when it is above a threshold, thereby avoiding saturation of low frequency noise, e.g., below 100 Hz. The low frequency noise can be caused by, for example, motion (e.g., bumps on the road) and touching the microphones. The low frequency noises can have relatively large amplitudes, which can cause saturation in the feedback loop, the feed forward loop, or both. FIG. 6 is an exemplary diagram illustrating compression of signal amplitude by a limiter (e.g., limiter 402) in accordance with an embodiment of the present disclosure. As shown in FIG. 6, the limiter may have a first signal amplitude threshold T1, a second signal amplitude threshold T2, and a third signal amplitude threshold T3, which have values from small to large, respectively, in this order. When the amplitude of the input signal of the limiter is between the first and third signal amplitude thresholds T1 and T3 ("b" in FIG. 6), the amplitude of the output signal of the limiter may be compressed to a value between the first and second signal amplitude thresholds T1 and T2. When the amplitude of the input signal of the limiter is above the third signal amplitude threshold T3 ("c" in FIG. 6), the amplitude of the output signal of the limiter may be compressed to the second signal amplitude threshold T2. When the amplitude of the input signal of the limiter is below the first signal amplitude threshold T1 ("a" in FIG. 6), the limiter may not compress the amplitude of the input signal.

Different from the example illustrated in FIG. 2, the example illustrated in FIG. 4 further includes a feed forward (FF) loop that can introduce the talk-through sound to speaker 104 (not shown) by external microphone 107. It is understood that ANC headphone 100 can include the feedback loop only or the feed forward look only in other embodiments. The feed forward loop may also include an ANC filter 403 that, when combined with ANC module 208, can reduce or remove the environmental noises picked up by external microphone 107 with the talk-through sound. In some embodiments, the feed forward loop further includes a talk-through filter 404 that, when combined with echo-cancel module 207, can reduce or remove the talk-through audio signal (obtained by internal microphone 103 based on the talk-through sound played by speaker 104) from its output, i.e., the echo-cancel audio signal. Because the talk-through audio signal has been reduced or even removed from the echo-cancel audio signal, the reduction of talk-through audio signal from the noise-controlled talk-through audio signal (which can cause volume and/or quality reduction of the talk-through sound) can be significantly improved.

As shown in FIG. 4, the feed forward loop may include external microphone 107 disposed outside the ear canal of the user when ANC headphone 100 is worn and configured to obtain a first talk-through audio signal, for example, based on a talk-through sound. In some embodiments, external microphone 107 obtains a mixed audio signal having the first talk-through audio signal as well as a noise signal based on the environmental noise outside the ear canal. The feed forward loop may include an ADC 405 that converts the first talk-through audio signal (or the mixed audio signal) from an analog signal to a digital signal, as well as a filter 406 that filters the first talk-through audio signal (or the mixed audio signal) in the digital format. In some embodiments, filter 406 is a minimum-phase filter with time delay having a sampling rate that can balance the power and time delay of filter 406. For example, the sampling rate of filter 406 is between 100 kHz and 500 kHz. In the case that the mixed audio signal including the noise signal is obtained by external microphone 107, ANC filter 403 may be configured to generate a cancellation signal based on the noise signal and provide the cancellation signal to adder 209 of ANC module 208, such that the noise signal can be reduced or even removed from the noise-controlled audio signal to be played by speaker 104. In some embodiments, a limiter 409 is arranged between ANC filter 403 and ANC module 208 to compress the amplitude of the cancellation signal to avoid saturation of the noise signal.

In some embodiments, talk-through filter 404 is configured to filter the first talk-through audio signal. Talk-through filter 404 may be any suitable digital filters, such as a FIR filter, an IIR filter, or a combination of FIR and IIR filters. Talk-through filter 404 may filter noise signals to keep talk-through sound in certain frequency ranges that the user is interested in. In some embodiments, talk-through filter 404 is sensitive to signals in a frequency range between 2 KHz and 30 KHz. The frequency of the filtered first talk-through audio signal may be between 2 KHz and 30 KHz. In some embodiments, a limiter 407 is arranged between talk-through filter 404 and echo-cancel module 207 to compress the amplitude of the filtered first talk-through audio signal to avoid saturation. Limiter 407 may be another example of the limiter described with respect to FIG. 6. In some embodiments, echo-cancel module 207 further includes an adder 408 that can combine both the audio source signal (e.g., music signal) and the talk-through signal. In other words, the feedback loop and feed forward loop can be operated individually or together.

In some embodiments, when the feed forward loop is operating either alone or in combination with the feedback loop, internal microphone 103 is configured to obtain a mixed audio signal including a noise signal and a second talk-through audio signal based on the audio played by speaker 104. The audio played may include talk-through sound based on the first talk-through audio signal obtained by external microphone 107, as well as environmental noises. Echo-cancel module 207 may be configured to reduce the second talk-through audio signal from the mixed audio signal based on the first talk-through audio signal to generate an echo-cancel audio signal. In some embodiments, the first talk-through audio signal is the filtered talk-through audio signal provided by the feed forward loop, e.g., by talk-through filter 404 (and limiter 407). To reduce the second talk-through audio signal from the mixed audio signal, echo-cancel filter 202 is configured to filter the first talk-through audio signal to generate a first cancellation signal, and adder 203 is configured to couple the first cancellation signal and the mixed audio signal to generate the echo-cancel audio signal, according to some embodiments. As described above in detail, echo-cancel filter 202 may be configured to adaptively adjust a parameter associated with the filtering based on the echo-cancel audio signal. In some embodiments, ANC filter 204 is configured to filter the echo-cancel audio signal to generate a second cancellation signal, and adder 209 is configured to couple the second cancellation signal and the first talk-through audio signal to generate the noise-controlled talk-through audio signal to be played by speaker 104.

Figure 5:
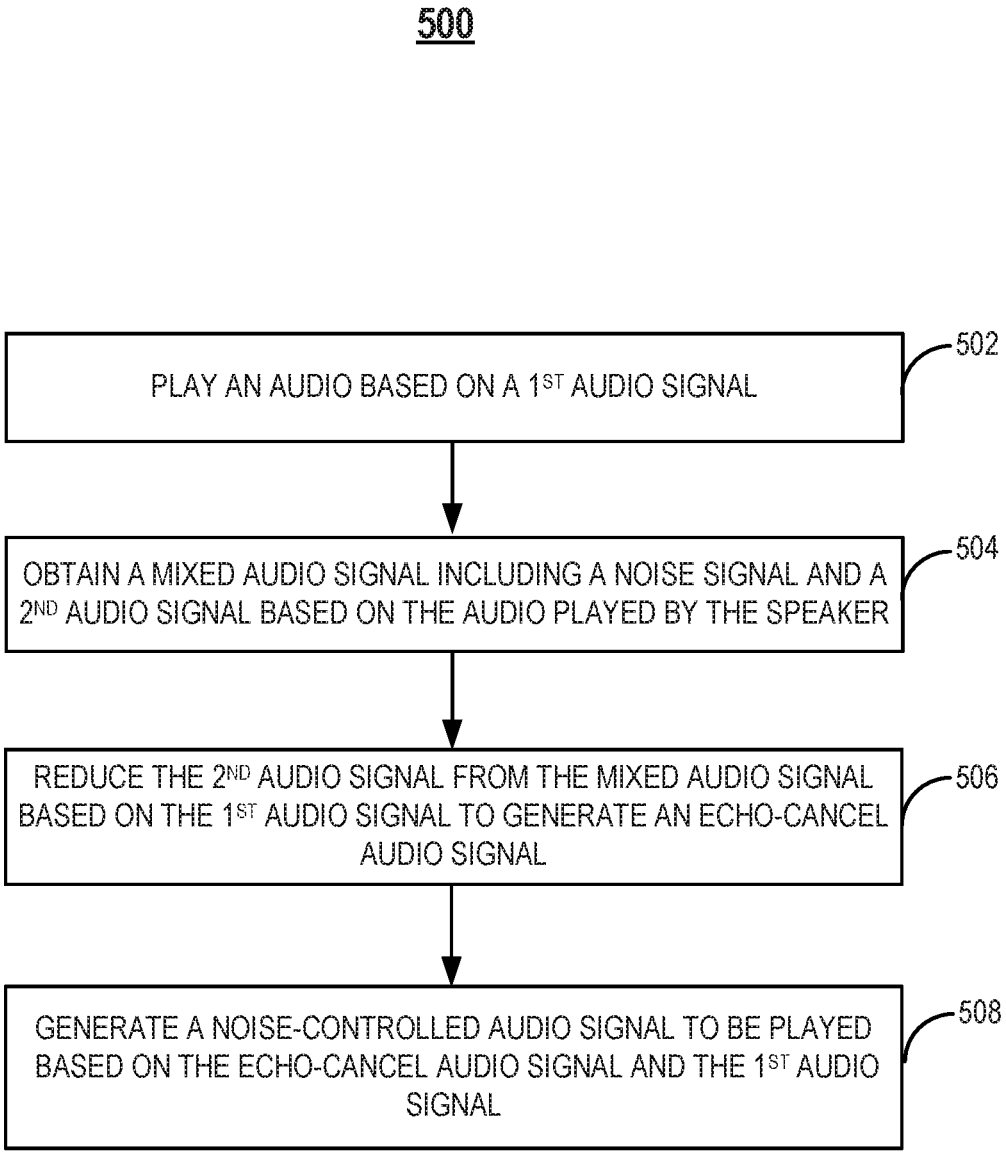
FIG. 5 is a flow chart illustrating an exemplary method for ANC in accordance with an embodiment of the present disclosure.

In some embodiments, when both the feedback and feed forward loops work together, speaker 104 is configured to play the audio based on both the first audio source signal (e.g., music signal) and the first talk-through audio signal, such that the mixed audio signal obtained by internal microphone 103 includes the second audio source signal, together with the second talk-through audio signal and the noise signal. In some embodiments, echo-cancel module 207 is further configured to reduce both the second audio source signal and the second talk-through audio signal from the mixed audio signal based on the first audio source signal and the first talk-through audio signal, respectively. In some embodiments, ANC module 208 is further configured to reduce the noise signal from the first audio source signal and first talk-through audio signal based on the echo-cancel audio signal. FIG. 5 is a flow chart illustrating an exemplary method 500 for ANC in accordance with an embodiment of the present disclosure. It is to be appreciated that not all operations may be needed to perform the disclosure provided herein. Further, some of the operations may be performed simultaneously, or in a different order than shown in FIG. 5, as will be understood by a person of ordinary skill in the art. Method 500 can be performed by ANC headphone 100. However, method 500 is not limited to that exemplary embodiment.

Starting at 502, an audio is played based on a first audio signal by a speaker. The first audio signal may be a music signal, a talk-through audio signal, or both music and talk-through audio signals. In some embodiments, the audio is played by speaker 104. In some embodiments, the talk-through audio signal is obtained, for example, by external microphone 107 prior to playing the audio based on the first audio signal.

At 504, a mixed audio signal including a noise signal and a second audio signal based on the audio played by the speaker is obtained by a microphone. In some embodiments, the mixed audio signal is obtained by internal microphone 103 disposed inside the ear canal of a user.

At 506, the second audio signal is reduced from the mixed audio signal based on the first audio signal to generate an echo-cancel audio signal by a processor. In some embodiments, to reduce the second audio signal from the mixed audio signal, the first audio signal is filtered, for example, by echo-cancel filter 202 of processor 102, to generate a first cancellation signal, and the first cancellation signal and the mixed audio signal are coupled, for example, by adder 203 of processor 102, to generate the echo-cancel audio signal.

At 508, a noise-controlled audio signal to be played by the speaker is generated, by the processor, based on the echo-cancel audio signal and the first audio signal. In some embodiments, to generate the noise-controlled audio signal, the echo-cancel audio signal is filtered, for example, by ANC filter 204 of processor 102, to generate a second cancellation signal, and the second cancellation signal and the first audio signal are coupled, for example, by adder 209 of processor 102, to generate the noise-controlled audio signal.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure or the appended claims in any way.

While the present disclosure has been described herein with reference to exemplary embodiments for exemplary fields and applications, it should be understood that the present disclosure is not limited thereto. Other embodiments and modifications thereto are possible, and are within the scope and spirit of the present disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments may perform functional blocks, steps, operations, methods, etc. using orderings different than those described herein.

The breadth and scope of the present disclosure should not be limited by any of the above-described exemplary embodiments, but should be defined only in accordance with the following claims and their equivalents.

What is claimed is:

1. A headphone for active noise control (ANC), comprising:

an external microphone configured to obtain a first talk-through audio signal;

a speaker configured to play an audio based on the first talk-through audio signal;

an internal microphone configured to obtain a mixed audio signal comprising a noise signal and a second talk-through audio signal based on the audio played by the speaker;

an echo-cancel module configured to reduce the second talk-through audio signal from the mixed audio signal based on the first talk-through audio signal to generate an echo-cancel audio signal; and an ANC module operatively coupled to the echo-cancel module and configure to generate a noise-controlled talk-through audio signal to be played by the speaker, the ANC module comprising:

an ANC filter configured to filter the echo-cancel audio signal to generate a first cancellation signal;

a first adder configured to couple the first cancellation signal and the first talk-through audio signal to generate the noise-controlled talk-through audio signal; and a first limiter operatively coupled between the ANC filter and the first adder and configured to reduce an amplitude of the first cancellation signal to a first preset level when the amplitude of the first cancellation signal is above a first threshold.

2. The headphone of claim 1, wherein the external microphone is disposed outside an ear canal when the headphone is worn, and the internal microphone is disposed inside the ear canal when the headphone is worn.

3. The headphone of claim 1, wherein the echo-cancel module comprises:

an echo-cancel filter configured to filter the first talk-through audio signal to generate a second cancellation signal; and a second adder configured to couple the second cancellation signal and the mixed audio signal to generate the echo-cancel audio signal.

4. The headphone of claim 1, wherein the first limiter has a first signal amplitude threshold, a second signal amplitude threshold, and a third signal amplitude threshold; and the first limiter is further configured to:

reduce the amplitude of the first cancellation signal to a value between the first and second signal amplitude thresholds when the amplitude of the first cancellation signal is between the first and third signal amplitude thresholds;

reduce the amplitude of the first cancellation signal to a value of the second signal amplitude threshold when the amplitude of the first cancellation signal is above the third signal amplitude threshold; and not reduce the amplitude of the first cancellation signal when the amplitude of the first cancellation signal is below the first signal amplitude threshold.

5. The headphone of claim 1, wherein the ANC filter is configured to reduce a gain of the ANC filter when a power of the echo-cancel audio signal is above a threshold.

6. The headphone of claim 1, wherein the speaker is further configured to play the audio based on a first audio source signal;

the mixed audio signal further comprises a second audio source signal based on the audio played by the speaker;

the echo-cancel module is further configured to reduce the second audio source signal from the mixed audio signal based on the first audio source signal; and the ANC module is further configured to generate a noise-controlled audio source signal to be played by the speaker based on the echo-cancel audio signal and the first audio source signal.

7. The headphone of claim 1, further comprising:

a talk-through filter configured to filter the first talk-through audio signal; and a second limiter operatively coupled between the talk-through filter and the echo-cancel module and configured to reduce an amplitude of the filtered first talk-through audio signal to a second preset level when the amplitude of the first talk-through audio signal is above a second threshold.

8. The headphone of claim 1, wherein the ANC filter is a minimum-phase filter with a time delay.

9. The headphone of claim 8, wherein the minimum-phase filter has a sampling rate that balances a power and the time delay of the minimum-phase filter.

10. A method for active noise control (ANC), comprising:

playing, by a speaker, an audio based on a first audio signal;

obtaining, by a microphone, a mixed audio signal comprising a noise signal and a second audio signal based on the audio played by the speaker;

reducing, by a processor, the second audio signal from the mixed audio signal based on the first audio signal to generate an echo-cancel audio signal; and generating, by the processor, a noise-controlled audio signal to be played by the speaker based on the echo-cancel audio signal and the first audio signal, wherein reducing the second audio signal from the mixed audio signal comprises:

filtering the first audio signal to generate a first cancellation signal, reducing an amplitude of the first cancellation signal to a preset level when the amplitude of the first cancellation signal is above a threshold, and coupling the first cancellation signal and the mixed audio signal to generate the echo-cancel audio signal.

11. The method of claim 10, wherein the first audio signal comprises at least one of a music signal and a talk-through audio signal.

12. The method of claim 11, further comprising obtaining, by another microphone, the talk-through audio signal.

* * * * *